US009777901B2

(12) United States Patent
Reinprecht et al.

(10) Patent No.: US 9,777,901 B2
(45) Date of Patent: Oct. 3, 2017

(54) HEADLIGHT FOR A MOTOR VEHICLE AND METHOD FOR DISTRIBUTING LIGHT

(71) Applicant: ZIZALA LICHTSYSTEME GMBH, Wieselburg (AT)

(72) Inventors: Markus Reinprecht, Wieselburg (AT); Friedrich Bauer, Bergland (AT); Bettina Reisinger, Amstetten (AT)

(73) Assignee: ZKW GROUP GMBH, Wieselburg an der Erlauf (AT)

( * ) Notice: Subject to any disclaimer, the term of this patent is extended or adjusted under 35 U.S.C. 154(b) by 0 days.

(21) Appl. No.: 14/766,369

(22) PCT Filed: Jan. 21, 2014

(86) PCT No.: PCT/AT2014/050021
§ 371 (c)(1),
(2) Date: Aug. 6, 2015

(87) PCT Pub. No.: WO2014/121315
PCT Pub. Date: Aug. 14, 2014

(65) Prior Publication Data

US 2015/0369437 A1 Dec. 24, 2015

(30) Foreign Application Priority Data

Feb. 7, 2013 (AT) ..... A 99/2013
Sep. 30, 2013 (AT) ..... A 50630/2013

(51) Int. Cl.
*F21V 11/00* (2015.01)
*F21S 8/10* (2006.01)
(Continued)

(52) U.S. Cl.
CPC ..... *F21S 48/1225* (2013.01); *F21S 48/1145* (2013.01); *F21S 48/1154* (2013.01);
(Continued)

(58) Field of Classification Search
CPC ..... F21S 48/1225; F21S 48/1145; F21S 48/1154; F21S 48/125; F21S 48/1757
See application file for complete search history.

(56) References Cited

U.S. PATENT DOCUMENTS

2009/0015388 A1 1/2009 Yagi et al.
2009/0046474 A1 2/2009 Sato et al.
(Continued)

FOREIGN PATENT DOCUMENTS

DE 102008022795 A1 11/2009
DE 102010028949 A1 11/2011
(Continued)

OTHER PUBLICATIONS

Search Report of Austrian Patent Application No. A 99/2013 dated Oct. 12, 2013.
(Continued)

*Primary Examiner* — Alexander Garlen
(74) *Attorney, Agent, or Firm* — Eversheds Sutherland (US) LLP

(57) ABSTRACT

A motor vehicle headlight with at least one modulable laser light source, whose laser beam is directed onto a means of light conversion through a means of beam deflection controlled by a beam deflection control, and with a projection system to project the light image produced by the means of light conversion onto the road, wherein a first group of at least two laser light sources is provided to produce a first group of at least two essentially horizontal light bands lying on top of one another on the means of light conversion and a second group of at least two laser light sources is provided to produce a second group of at least two essentially horizontal light bands lying on top of one another on the means of light conversion, wherein the light bands of the first group and the light bands of the second group overlap one another.

21 Claims, 3 Drawing Sheets

Figure 1:
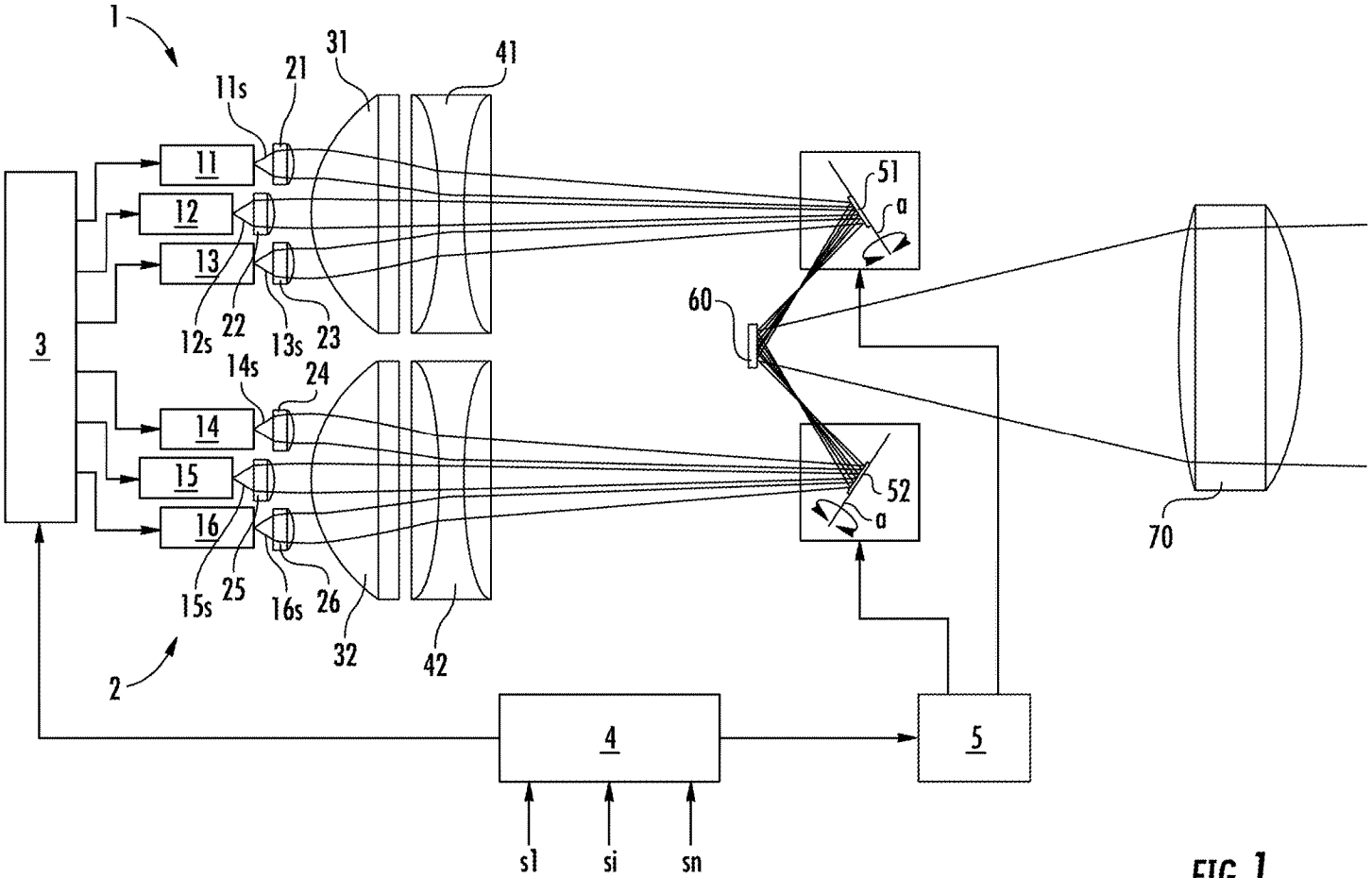

(51) Int. Cl.
*F21Y 101/00* (2016.01)
*F21Y 115/30* (2016.01)

(52) U.S. Cl.
CPC ..... *F21S 48/125* (2013.01); *F21S 48/1757* (2013.01); *F21Y 2101/00* (2013.01); *F21Y 2115/30* (2016.08)

(56) References Cited

U.S. PATENT DOCUMENTS

| | | | | |
|---|---|---|---|---|
| 2011/0249460 | A1 | 10/2011 | Kushimoto | |
| 2012/0051027 | A1* | 3/2012 | Takahashi | F21S 48/1145 362/84 |
| 2012/0106189 | A1* | 5/2012 | Takahashi | B60Q 1/0035 362/538 |
| 2013/0265561 | A1* | 10/2013 | Takahira | F21V 7/06 356/3 |

FOREIGN PATENT DOCUMENTS

| | | | |
|---|---|---|---|
| EP | 2023170 | A2 | 11/2009 |
| EP | 2537708 | A2 | 12/2012 |
| EP | 2541129 | A2 | 2/2013 |
| WO | 9911968 | A1 | 11/1999 |

OTHER PUBLICATIONS

International Search Report of WO 2014/121315 dated Apr. 16, 2014.

* cited by examiner

HEADLIGHT FOR A MOTOR VEHICLE AND METHOD FOR DISTRIBUTING LIGHT

The invention relates to a process for producing a specified light pattern on a road using a motor vehicle headlight, wherein at least one modulated laser beam is directed onto a means of light conversion through at least one means of beam deflection, and the light image produced on the means of light conversion is projected onto the road.

The invention also relates to a motor vehicle headlight with at least one modulable laser light source whose laser beam is directed onto at least one means of light conversion through a means of beam deflection controlled by a beam deflection control, and with a projection system to project the light image produced by the means of light conversion onto the road.

The use of laser light sources in motor vehicles is at currently becoming more important, since laser diodes allow more flexible and more efficient solutions, allowing a substantial increase in the light beam's luminance and the luminous efficiency.

However, the known solutions do not involve the direct emission of a laser beam, to prevent the extremely concentrated high-power light beam from endangering the eyes of humans and other living things. Instead, the laser beam is converted, on an interposed converter that contains a luminescence conversion material, called "phosphor" for short, from, e.g., blue light preferably into "white" light.

EP 2 063 170 A2 discloses a motor vehicle headlight of the type mentioned at the beginning that can, to illuminate the road with a nonglare, adaptive high beam, omit certain areas depending on other road users. The laser beam is directed, through a micromirror that can move in at least two directions in space, onto an emitting surface containing a phosphor to convert the laser light into (preferably) white light. A lens is used to project the emitting surface's light image onto the road. Since the micromirror must deflect a concentric laser beam, it is exposed to a correspondingly high specific load per unit area, which makes its construction more expensive.

DE 10 2008 022 795 A1 discloses a motor vehicle headlight in which the beams of three semiconductor lasers of the colors red, green, and blue are united by an achromatic lens into a white beam that strikes a mirror that oscillates about two axes. A control device modulates the beam power in such a way that specified areas of the mirror are illuminated with specified power. In one embodiment, the mirror can be coated with a converter material. Another embodiment has a controlled micromirror array. In this embodiment, a laser beam strikes a diffuser that is simultaneously a light converter and that illuminates the micromirror array. Projection optics can project the desired image produced by the mirror array onto the road.

Quite generally, it is desired that adaptive headlight systems (AFS=Adaptive Frontlighting Systems) have more functionalities with high resolution and short reaction times. However, the known devices are either very complex or have resolution problems in at least one direction, usually horizontally. This also applies for headlights that use an LED matrix for illumination in which segments of the matrix can be turned on or off. In this case, the best resolution is 1.5°. Furthermore, light images produced with laser light sources often also have undesired color effects on the edges.

A goal of the invention is to create a process or a headlight of the type that is the subject of the invention that has improved resolution in the horizontal direction and meets the above-mentioned requirements on AFS functions, without having a highly complex structure, and ensures high dynamics of the light intensity within the light image, while minimizing undesired color effects.

This goal is achieved with an inventive process of the type mentioned at the beginning, in which the laser beams of a first group of at least two laser light sources are directed, through the means of beam deflection, onto the at least one means of light conversion to produce a first group of at least two essentially horizontal light bands lying on top of one another, and the laser beams of another, second group of at least two laser light sources are directed, through the means of beam deflection, onto the at least one means of light conversion to produce a second group of at least two essentially horizontal light bands lying on top of one another, the light bands of the first group and light bands of the at least second group overlapping one another.

In practice it has proved expedient for the overlap to be between 10 and 90% of the height of the light bands, preferably 50%.

It is advantageous for the adjustment capability if the distance of the light bands from one another, and thereby the extent of the overlap, to be determined by the angle of incidence of the laser beams on the means of beam deflection.

An expedient variant provides that the means of beam deflection have at least one micromirror that can pivot about an axis, since proven implementations of such micromirrors are available to the designer.

To simplify the adjustment, the length of the light bands can be adjusted through the oscillation amplitude of the micromirror.

Free selection of spot geometry is possible if the shape and size of the spots produced on the means of light conversion are determined by the beam-forming optics and/or the choice of the distance of the means of light conversion from the focal points of these optical systems.

Here it is especially advantageous if spots are produced in an ellipse-like shape with a longer vertical axis.

This goal can also be achieved using a headlight of the indicated type, in which a first group of at least two laser light sources is inventively provided to produce a first group of at least two essentially horizontal light bands lying on top of one another on the at least one means of light conversion, and a second group of at least two laser light sources is inventively provided to produce a second group of at least two essentially horizontal light bands lying on top of one another on the at least one means of light conversion, the laser light sources having a laser control assigned to them and the laser beams being directed through the means of beam deflection onto the at least one means of light conversion in such a way that the light bands of the first group and the light bands of the second group overlap one another.

It is advantageous for the overlap of the light bands to be between 10 and 90% of the height of the light bands, preferably 50%.

It is also advantageous for the distance of the light bands from one another, and thereby the extent of the overlap, to be determined by the angle of incidence of the laser beams on the means of beam deflection.

A pleasant light image that meets the requirements is obtained if the light bands produced by the laser light sources of the first group and the light bands produced by the laser light sources of the second group are directly adjacent to one another, without any separation.

A practical design results if the means of beam deflection have at least one micromirror that can pivot about an axis.

Here it has proved very expedient for the micromirror to be controlled through the beam deflection control with its mechanical natural frequency.

Not least of all to spread out the lost heat that must be dissipated, it is useful for each group of laser light sources to have a micromirror assigned to it.

It is also advantageous, if the horizontal swing amplitude of the micromirrors can be changed through the beam deflection control.

To allow the spots to be adjusted in various ways, it is advisable for each laser light source to have downstream collimating optics.

It has also turned out to be especially practical for each group of laser light sources and the means of beam deflection to have a converging lens followed by a diverging lens arranged between them.

With respect to size and power, it is expedient for the laser light sources to be laser diodes.

Figure 2A:
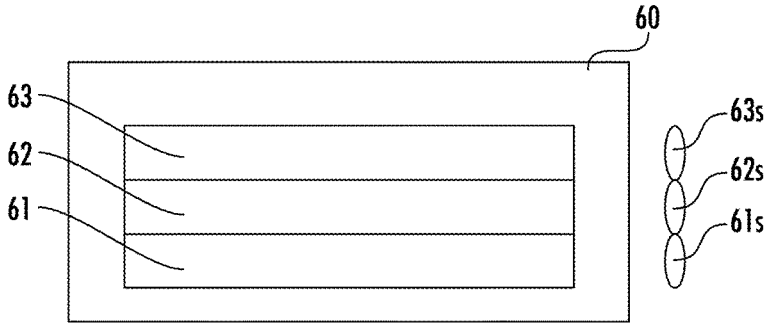
Figure 2B:
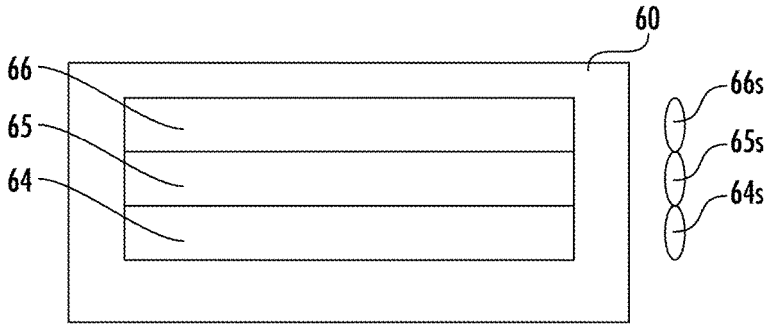
Figure 2C:
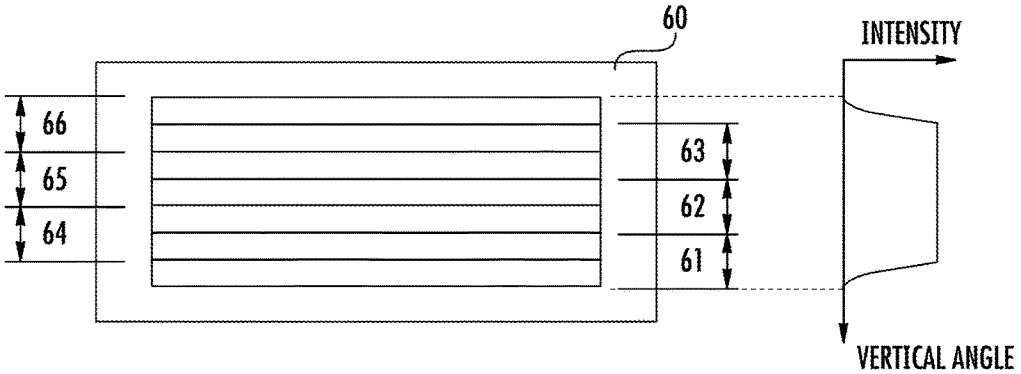
Figure 3:
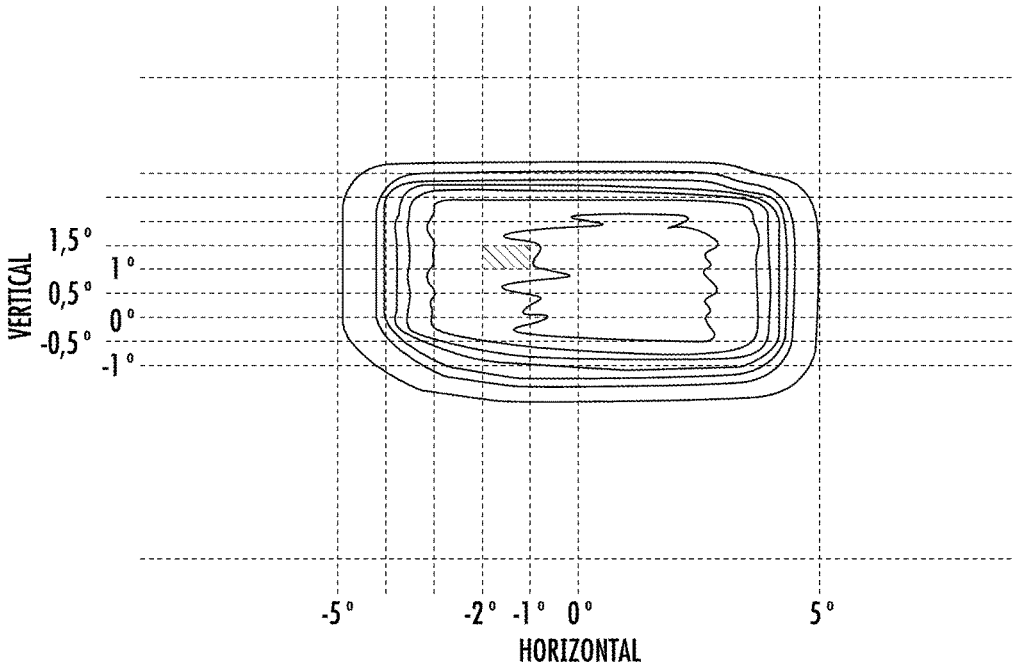
Figure 4:
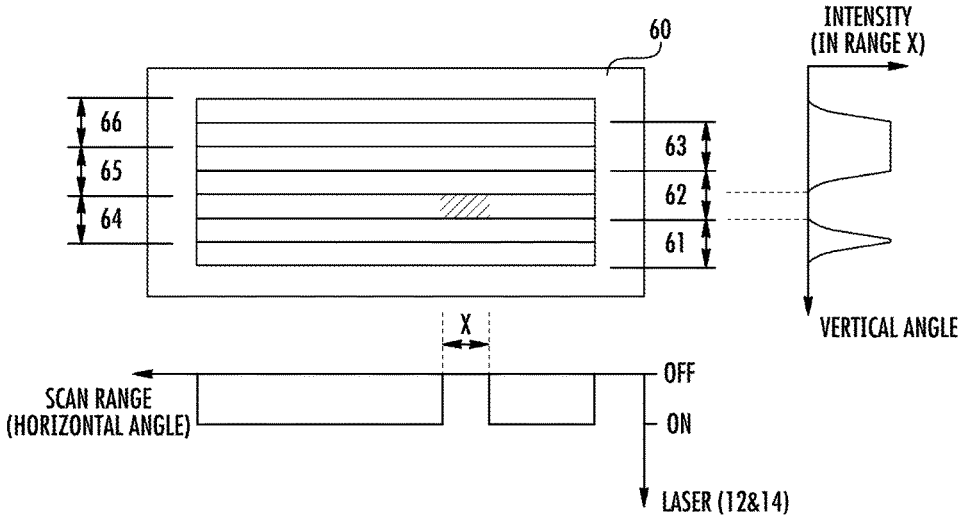

Finally, each group of laser light sources can also have a means of light conversion and a projection system assigned to it. This means that two separate headlight modules can be provided that each consist of, e.g., three lasers with the associated lenses, a means of light deflection, e.g., a micromirror and a means of light conversion (emitting surface), and a projection system (e.g., a projection lens), the two headlight modules being oriented in such a way with respect to one another that there is overlap of the light bands, namely the images of the light bands projected forward from the two emitting surfaces, outside the headlight onto the road. Such a design can be advantageous from the perspective of production engineering. The invention, along with further advantages, is explained in detail below using sample embodiments that are illustrated in the drawing. The figures are as follows:

FIG. 1 schematically shows the components of a headlight that are essential for the invention and their relationship;

FIG. 2*a* shows the spots or light bands produced on an emitting surface by a first group of laser light sources;

FIG. 2*b* shows the spots or light bands produced on an emitting surface by a second group of laser light sources;

FIG. 2*c* shows the light bands produced together on an emitting surface by a first group and a second group of laser light sources, which overlap one another, and the intensity curve;

FIG. 3 shows an overall light image that is common in automotive engineering, namely a central high beam image, in which a marked area is cut out; and FIG. 4 shows a picture analogous to FIG. 2 of a cut out area in a light band and the intensity or the on/off diagram of the affected laser light sources.

With reference to FIG. 1, a sample embodiment of the invention is now explained in detail. In particular, it shows the parts that are important for an inventive headlight, it being clear that a motor vehicle headlight also contains many other parts that allow it be used in a meaningful way in a motor vehicle, such as, in particular, a passenger vehicle or motorcycle. From the perspective of illuminating engineering, the starting point of the headlight is two groups 1 and 2, lying on top of one another here, each group comprising three laser light sources 11, 12, 13 and 14, 15, 16, each of which can emit a laser beam, designated as 11*s* through 16*s*. Laser light sources 11 through 16 have a laser control 3 assigned to them which supplies current and which is also set up to modulate the beam intensity of the individual lasers. In the context of this invention, the term "modulate" is understood to mean that the intensity of a laser light source can be changed, either continuously or in a pulsed manner, in the sense of being turned on or off. It is essential that it be possible for the light output to be dynamically changed in an analogous manner, depending on where the beams are directed. In addition, it is also possible for the light to be turned on and off for a certain time, in order not to illuminate defined places.

As for the laser control 3, it in turn receives signals from a central headlight control 4, to which sensor signals s1 . . . si . . . sn can be fed. On the one hand, these control and sensor signals can be, for example, switching commands to switch from high beams to low beams, or on the other hand signals that are picked up from light sensors or cameras, which sense the illumination conditions on the road, and are intended to cut out or weaken certain areas in the light image, for example. Laser light sources 11 through 16, which are preferably laser diodes, emit blue or UV light, for example.

Each laser light source 11 through 16 has its own collimating optics 21 through 26 downstream of it, which concentrate the laser beam 11*s* through 16*s*, which is strongly divergent at first. Then, the separation of the laser beams in the first group 1 and in the second group 2 is reduced in each group by a common converging lens 31 or 32, and downstream diverging lenses 41 or 42 keep the exit angle of the laser beams as small as possible.

The three laser beams 11*s*, 12*s*, 13*s* of the first group 1 that are "concentrated" in the described manner strike a first micromirror 51, and laser beams 14*s*, 15*s*, 16*s* of the second group 2 strike a second micromirror 52 in an analogous manner and are reflected together on means of light conversion 60, in this case in the form of an emitting surface, which has a phosphor for light conversion in a manner known in the art. The phosphor converts blue or UV light into "white" light, for example. In the context of this invention, the term "phosphor" is quite generally understood to mean a substance or a mixture of substances that converts light of one wavelength into light of another wavelength or of a mixture of wavelengths, in particular, into "white" light, which can be subsumed under the term "wavelength conversion". Here the term "white light" is understood to mean light having a spectral composition that gives humans the impression of a "white" color. Of course the term "light" is not limited to radiation that is visible to the human eye. Possible means of light conversion also include optoceramics, that is, transparent ceramics, such as, for example, YAG-Ce (cerium-doped yttrium aluminum garnet).

The micromirror 50 oscillating only about a single axis is controlled by mirror control 5 and made to oscillate at a constant frequency; these oscillations can correspond especially to the micromirror's mechanical natural frequency. As for the mirror control 5, it is controlled by headlight control 4, to allow adjustment of the oscillation amplitude of micromirrors 51, 52, even asymmetric oscillations about the axis a being adjustable. The control of micromirrors is known, and can be done in many ways, e.g., electrostatically or electrodynamically. In tested embodiments of the invention, micromirrors 51, 52 oscillate, for example, with a frequency of a few hundred Hz, and their maximum deflection is a few degrees to 60°, depending on their control. It is expedient for feedback about the position of micromirrors 51, 52 to be sent to mirror control 5 and/or headlight control 4. The two micromirrors can oscillate synchronously, however asynchronous oscillation can also be used, for example to make the thermal load on the emitting surface or the means of light conversion more uniform.

Although the preferred sample embodiment shows micromirrors that only oscillate about one axis, it is also possible to use micromirrors that oscillate about two axes. In this case, several laser beams can be directed onto such a micromirror, which then produces overlapping or directly adjacent light bands. Designs with only a single micromirror are also conceivable; in these designs, for example, the laser beams [travel in the direction] opposite the headlight's main emission direction and directly strike the micromirror, which then reflects the laser beams onto an illuminated phosphor. However, the division into two groups of laser light sources and the use of two micromirrors has advantages with respect to a compact structure and easily controllable heat dissipation, especially since the possible thermal load of a micromirror is limited.

The mode of operation of the example of a headlight that operates according to the inventive process is explained below.

The concentrated laser beams 11*s*, 12*s*, 13*s* of the first group 1 of laser light sources 11, 12, 13 produce, on the means of light conversion 60, namely on the emitting surface, which is generally flat, however need not be flat, horizontal light bands 61, 62, 63 (FIG. 2*a*), the angle of laser light sources 11, 12, 13 with respect to micromirror 51 being adjusted in such a way that the light bands on the emitting surface lie on top of one another and border one another, the distance of the light bands from one another preferably being zero. Corresponding adjustment of laser light sources 11, 12, 13 or the following lenses 21, 22, 23, 31, 41 can adjust this exactly and produce, on the means of light conversion 60, here the emitting surface, a light image, which in this case is composed of three light bands 61, 62, 63.

The spots 61*s*, 62*s*, 63*s* that would be seen if mirror 51 were stationary and that correspond to the respective laser beam cross section at this place are schematically shown to the right of the symbolically shown emitting surface or means of light conversion 60. The size of the spots can be determined, in particular, by the position of the emitting surface 60 with respect to the optical system 21, 31, 41. The farther the means of light conversion 60 are outside of the associated focal point, the larger the spots become. The shape of the spots is also determined a priori by the laser light sources used in each case. Thus, for example, the beam cross section of semiconductor lasers is always elliptical, with intensity decreasing toward the edge according to a Gaussian distribution, however can be changed by corresponding optical means.

The spot sizes used do not have to be the same everywhere. For example, in practice the highest, resolution is desired in the middle of the overall light image, and accordingly in this area it is preferred for light bands to be generated by smaller spot sizes that are superimposed.

The light bands 64, 65, 66 or spots 64*s*, 65*s*, 66*s* shown in FIG. 2*b* are produced in a completely analogous manner, but it can be seen that the totality of these light bands is shifted upward with respect to the totality of light bands 61, 62, 63 by half the width of a light band.

The described displacement makes the light bands of the first group and the light bands of the second group overlap, in the case shown in FIG. 2*c*, by about 50% of their width. Thus, in summary there are seven light bands (FIG. 2*c*), the upper and lower of which show outward decreasing intensity, the curve, which is typical for laser diodes, approximately following a Gaussian distribution.

An advantage of the invention can already be seen here, namely the absence of abrupt intensity transitions within the light image, which also makes the adjustment of the individual laser light sources and optical systems less critical, even if the light bands shown in FIGS. 2*a* and 2*b* do not lie "exactly" on top of one another.

It is also possible for the upper and lower edges of the light image, which show outward decreasing intensity, each to have one light band that is produced from a half-sized laser spot to fill this edge area exactly.

The jointly produced light image is now projected forward as an overall light image (FIG. 3) with a projection system 70. The use of light bands projected onto a road is especially expedient, since these light bands then make it possible, for example, to generate high beams, a light/dark boundary, and low beams (forward light) in a simple way.

It should also be pointed out that all light bands in the drawing are drawn with the same "height", however this is not at all necessary. For example, the light bands for high beams can be "higher" than those for low beams or for the light/dark boundary, whose dimension is the smallest in the height direction. If a change is made in the height of individual light bands, of course the angle of the laser or laser beams to one another must also be changed, to make the distance between the light bands equal to zero again.

It should be clear that the term "horizontal" should be understood in a relative meaning here, and relates to a level road or to a normal position of the vehicle, and is only used to make the discussion easier to read, and thus should not be understood to be restrictive. The same goes for the term "vertical" that is used. In this regard, it should also be pointed out that in theory rotating the arrangement by 90° also makes it conceivable to produce light bands that run in the vertical direction It is now apparent that, on the one hand, it is possible to change the light image, and thus also road illumination by adjusting the oscillation amplitude of micromirror 51, which changes the length of horizontal light bands, and on the other hand, it is possible to change the intensity distribution within each light band by adjusting the intensity of the individual laser light sources. In addition, it should be noted that it is possible to control high-frequency laser light sources, whether pulsed or with continuous intensity modulation, so that any light patterns within the light bands, which correspond to the respective position of the micromirrors 51, 52, are not only adjustable but rather also rapidly changeable, if a special terrain or driving situation requires this, for example, if oncoming vehicles or pedestrians are picked up by sensors and a corresponding change in the geometry and/or intensity [of] road illumination 52' is desired in connection with this.

This is now explained in detail with reference to FIGS. 3 and 4. If the crosshatched area shown in FIG. 3 that lies between −1° and −2° on the horizontal axis and between 1° and 1.5° on the vertical axis is supposed to be cut out, the laser light sources that form the affected segment are turned off or dimmed. Since the light bands in the example are 62 and 64, laser light sources 12 and 14 are turned off for the scan time period belonging to the scan length X. The diagrams under the emitting surface of FIG. 4 or on the right next to the emitting surface illustrate the turning on/off of the laser light sources or the resulting intensity curve.

In the sample embodiment shown, the light bands on an emitting surface or means of light conversion overlap, and the light image thus produced is projected onto the road. However, it is also possible for two separate headlight modules to be provided that each consist of, e.g., three lasers with the associated lenses, a means of light deflection, e.g., a micromirror, and a means of light conversion (emitting surface), and a projection system (e.g., a projection lens), the two headlight modules being oriented in such a way with respect to one another that there is overlap of the light bands, namely the images of the light bands projected forward from the two emitting surfaces, outside the headlight onto the road. Such a headlight would be built as shown in FIG. 1, except that it would have two means of light conversion 60 or emitting surfaces, each of which is assigned to one of micromirrors 51, 52, and also two projection systems 70 or lenses. Even though the sample embodiment shown is described as having two groups, each with three laser light sources, it should be clear to the person skilled in the art that it is also conceivable for the purpose of the respective application for there to be several groups with other and a different number of laser light sources. Furthermore, a 50% overlap of the light bands is not at all necessary: overlaps of 10% to 90% are quite possible in practice.

LIST OF REFERENCE NUMBERS

1 Group
2 Group
3 Laser control
4 Headlight control
5 Mirror control
11 Laser light source
12 Laser light source
13 Laser light source
14 Laser light source
15 Laser light source
16 Laser light source
11*s* Laser beam
12*s* Laser beam
13*s* Laser beam
14*s* Laser beam
15*s* Laser beam
16*s* Laser beam
21 Collimating optics
22 Collimating optics
23 Collimating optics
24 Collimating optics
25 Collimating optics
26 Collimating optics
31 Converging lens
32 Converging lens
41 Diverging lens
42 Diverging lens
51 Micromirror
52 Micromirror
51, 52 Means of beam deflection
60 Means of light conversion (emitting surface)
61 Light band
62 Light band
63 Light band
64 Light band
65 Light band
66 Light band
61*s* Spot
62*s* Spot
63*s* Spot
64*s* Spot
65*s* Spot
66*s* Spot
70 Projection system
a Axis
si Sensor signals

The invention claimed is:

1. A process for producing a specified light pattern on a road using a motor vehicle headlight, comprising:

directing at least one modulated laser beam onto a means of light conversion through at least one means of beam deflection, and projecting a light image produced on the means of light conversion onto the road, wherein laser beams of a first group of at least two laser light sources are directed, through the at least one means of beam deflection, onto the at least one means of light conversion to produce a first group of at least two substantially horizontal light bands lying on top of one another, wherein laser beams of a second group of at least two laser light sources are directed, through the at least one means of beam deflection, onto the at least one means of light conversion to produce a second group of at least two substantially horizontal light bands lying on top of one another, wherein the light bands of the first group and the light bands of the second group partially overlap one another at the same time along a vertical axis.

2. The process of claim 1, wherein the overlap is between about 10% and 90% of a height of the light bands.

3. The process of claim 1, wherein a distance of the light bands from one another, and thereby an extent of the overlap, is determined by an angle of incidence of the laser beams on the at least one means of beam deflection.

4. The process of claim 1, wherein the at least one means of beam deflection have at least one micromirror pivoting about an axis.

5. The process of claim 4, further comprising oscillating an amplitude of the at least one micromirror to adjust a length of the light bands.

6. The process of claim 1, wherein a shape and size of spots produced on the at least one means of light conversion are determined by beam-forming optics and/or a distance of the at least one means of light conversion from focal points of the beam-forming optics.

7. The process of claim 6, wherein the spots are produced in an ellipse-like shape with a longer vertical axis.

8. The process of claim 1, wherein the first group of at least two laser light sources are associated with a first mean of deflection, and wherein the second group of at least two laser light sources are associated with a second mean of deflection.

9. A motor vehicle headlight, comprising:

at least one modulable laser light source having a laser beam that is directed onto at least one means of light conversion, which has a phosphor for light conversion, through a means of beam deflection controlled by a beam deflection control, and with a projection system to project a light image produced by the at least one means of light conversion onto a road, a first group of at least two laser light sources to produce a first group of at least two substantially horizontal light bands lying on top of one another on the at least one means of light conversion, and a second group of at least two laser light sources to produce a second group of at least two substantially horizontal light bands lying on top of one another on the at least one means of light conversion, wherein the laser light sources have a laser control assigned to them and are configured to produce laser beams that are directed through the means of beam deflection onto the at least one means of light conversion in such a way that the light bands of the first group and the light bands of the second group partially overlap one another at the same time along a vertical axis.

10. The headlight of claim 9, wherein the overlap of the light bands is between about 10% and 90% of the height of the light bands.

11. The headlight of claim 9, wherein a distance of the light bands from one another, and thereby an extent of the overlap, is determined by an angle of incidence of the laser beams on the means of beam deflection.

12. The headlight of claim 9, wherein the light bands produced by the laser light sources of the first group and the light bands produced by the laser light sources of the second group are directly adjacent to one another, without any separation.

13. The headlight of claim 9, wherein the means of beam deflection have at least one micromirror pivoting about an axis.

14. The headlight of claim 13, wherein the at least one micromirror is controlled through the beam deflection control, which oscillates the at least one micromirror at its mechanical natural frequency.

15. The headlight of claim 9, wherein each group of laser light sources has a micromirror assigned to it.

16. The headlight of claim 15, wherein a horizontal swing amplitude of the micromirrors can be changed through the beam deflection control.

17. The headlight of claim 9, wherein each laser light source has collimating optics downstream of it.

18. The headlight of claim 17, wherein each group of laser light sources and the means of beam deflection have a converging lens followed by a diverging lens arranged between the collimating optics and the means of beam deflection.

19. The headlight of claim 9, wherein the laser light sources are laser diodes.

20. The headlight of claim 9, wherein each group of laser light sources has a means of light conversion and a projection system assigned to it.

21. The headlight of claim 9, wherein the overlap of the light bands is about 50% of the height of the light bands.

* * * * *